US007297232B2

(12) United States Patent
Tsuura et al.

(10) Patent No.: US 7,297,232 B2
(45) Date of Patent: Nov. 20, 2007

(54) PRODUCTION METHOD AND DEVICE FOR FIBER MOLDING

(75) Inventors: Tokuo Tsuura, Tochigi (JP); Masayuki Osaki, Tochigi (JP)

(73) Assignee: Kao Corporation, Tokyo (JP)

( * ) Notice: Subject to any disclaimer, the term of this patent is extended or adjusted under 35 U.S.C. 154(b) by 0 days.

(21) Appl. No.: 10/380,766

(22) PCT Filed: Jul. 18, 2002

(86) PCT No.: PCT/JP02/07317

§ 371 (c)(1),
(2), (4) Date: Aug. 13, 2003

(87) PCT Pub. No.: WO03/010386

PCT Pub. Date: Feb. 6, 2003

(65) Prior Publication Data

US 2004/0041305 A1 Mar. 4, 2004

(30) Foreign Application Priority Data

Jul. 24, 2001 (JP) ..... 2001-223626

(51) Int. Cl.
*D21F 13/00* (2006.01)

(52) U.S. Cl. ..... 162/218; 162/221; 162/224; 162/226; 264/335; 425/116; 425/145

(58) Field of Classification Search ..... 162/218, 162/221, 224, 226; 264/335; 425/116, 145
See application file for complete search history.

(56) References Cited

U.S. PATENT DOCUMENTS 2,961,043 A 11/1960 Hicks
6,875,384 B1 * 4/2005 Whitney ..... 264/40.5

FOREIGN PATENT DOCUMENTS

| | | | |
|---|---|---|---|
| EP | 1219748 | * | 7/2002 |
| JP | 08-209600 | | 8/1996 |
| JP | 10-227000 | * | 8/1998 |
| JP | 2000-34700 | | 2/2000 |
| JP | 2001-106220 | | 4/2001 |
| WO | 01-11141 A1 | | 2/2001 |

* cited by examiner

*Primary Examiner*—Mark Halpern
(74) *Attorney, Agent, or Firm*—Oblon, Spivak, McClelland, Maier & Neustadt, P.C.

(57) ABSTRACT

A method for producing a fiber molded article comprising the step of transferring a fiber molded article 10 formed in a papermaking mold 2 composed of splits 20 and 20' to a split 30' of a drying mold 3, in which the papermaking mold 2 is once opened while attracting the fiber molded article 10 to the inner surface of the split 20' by suction to separate the fiber molded article 10 from the inner surface of the split 20, the papermaking mold 2 is closed, the suction by the split 20' is stopped, the papermaking mold 2 is opened again while attracting the fiber molded article 10 to the inner surface of the split 20 to separate the fiber molded article 10 from the split 20', the split 20 is joined with the split 30', the fiber molded article 10 is attracted to the inner surface of the split 30' by suction, and the fiber molded article 10 is separated from the split 20.

20 Claims, 3 Drawing Sheets

2
20
20'
200
21
S1'
S2'
S3'
S1
S2
S3
210
210'
220
201
201'
202
202'
203
203'
211
211'
10
C 3
30
30'
8
10
C'
S10
S10'
S20
S20'
S30
S30'
300
301
301'
302
302'
311
311'
320

PRODUCTION METHOD AND DEVICE FOR FIBER MOLDING

This application is a 371 of PCT/JP02/07317 filed 18 Jul. 2002.

TECHNICAL FIELD

The present invention relates to a method of producing a fiber molded article comprising a step of transferring a fiber molded article formed in a papermaking mold composed of a set of splits to another mold and an apparatus therefor.

BACKGROUND ART

Some methods of producing pulp molded articles involve a step of transferring a molded article having been formed and dewatered in a papermaking mold to a drying mold for drying the molded article. The technique described in JP-A-10-227000 is included under this type of methods.

According to the technique disclosed, a papermaking mold (upper mold) is immersed in a raw material slurry, and the slurry is sucked up to deposit the pulp component on the inner surface (a papermaking screen) of the papermaking mold. The papermaking mold is pulled out of the slurry, and the suction is continued to dewater the pulp component to obtain a molded article having a prescribed water content. The papermaking mold is joined with another mold (lower mold). The suction through the papermaking mold is stopped so that the molded article is transferred to the other mold by its own weight. The other mold is then joined with a drying mold (another upper mold) to dry the molded article.

However, the operation of transferring a pulp molded article from a papermaking mold to another mold sometimes fails because the molded article has been brought into intimate contact with the inner surface of the papermaking mold (papermaking screen) by the suction force exerted for dewatering. Where, in particular, a hollow bottle-shaped pulp molded article is formed and dewatered on a papermaking mold composed of a set of splits and then transferred to another mold by (i) opening the split papermaking mold with the molded article stuck to one of the splits and (ii) attracting the molded article to the other mold by suction, the papermaking screens provided on the inner surface of the splits leaves their mesh marks on the outer surface of the molded article during dewatering. The mesh marks cause a gap between the molded article and the other mold. As a result, the suction force exerted between the other mold and the molded article tends to be insufficient for stably transferring the molded article between the two molds.

Accordingly, an object of the present invention is to provide a method and an apparatus for producing a fiber molded article in which a fiber molded article formed in a papermaking mold can be transferred to another mold stably and securely.

DISCLOSURE OF THE INVENTION

The present invention accomplishes the above object by providing a method of producing a fiber molded article comprising the step of transferring a fiber molded article formed in a papermaking mold composed of a set of splits to another mold other than the papermaking mold, wherein the step of transferring is carried out by opening the papermaking mold while attracting the fiber molded article to the inner surface of one of the splits by suction to separate the fiber molded article from the other split, closing the papermaking mold, releasing the molded article from attraction to the inner surface of the one of the splits, opening the papermaking mold again while attracting the fiber molded article to the inner surface of the other split by suction, joining the other split with the another mold, attracting the fiber molded article to the inner surface of the another mold by suction, and separating the fiber molded article from the other split.

The present invention also accomplishes the above object by providing an apparatus for producing a fiber molded article comprising a papermaking mold composed of a set of splits, another mold other than the papermaking mold for receiving the molded article formed in the papermaking mold, a moving means for moving the set of splits and the another mold, a suction means for attracting the fiber molded article to the inner surface of the splits and the inner surface of the another mold, and a control means for controlling the moving means and the suction means, wherein the control means controls the moving means and the suction means such that:

the papermaking mold is opened while attracting the fiber molded article to the inner surface of one of the splits of the papermaking mold by suction to separate the fiber molded article from the other split, the papermaking mold is closed, and the molded article is released from attraction to the inner surface of the papermaking mold, the papermaking mold is opened again while attracting the fiber molded article to the inner surface of the other split by suction to separate the fiber molded article from the inner surface of the one of the splits, the other split is joined with the another mold, and the fiber molded article is attracted to the inner surface of the another mold by suction, and the fiber molded article is separated from the other split.

BRIEF DESCRIPTION OF THE DRAWINGS

FIG. 1(*a*) shows the state after papermaking. FIG. 1(*b*) shows the papermaking mold in an opened state. FIG. 1(*c*) shows the papermaking mold in a re-closed state. FIG. 1(*d*) shows the molded article attracted to one split. FIG. 1(*e*) shows the split of the papermaking mold and a split of the drying mold facing each other. FIG. 1(*f*) shows the papermaking mold split and the drying mold split joined together. FIG. 1(*g*) shows the molded article having been transferred to the drying mold split. FIG. 1(*h*) shows the state immediately before joining a pair of drying mold splits.

FIG. 2(*a*) illustrates the state after papermaking. FIG. 2(*b*) shows the papermaking mold in an once opened state. FIG. 2(*c*) shows the papermaking mold in a re-closed state. FIG. 2(*d*) shows the molded article attracted to one of the splits by suction.

FIG. 3(*a*) shows the molded article placed in the drying mold. FIG. 3(*b*) shows a pressing member which is being inserted into the molded article. FIG.

3(*c*) shows the pressing member expanded to press and dry the molded article. FIG. 3(*d*) shows the drying mold in an opened state.

BEST MODE FOR CARRYING OUT THE INVENTION

The present invention will be described based on its preferred embodiment by referring to the accompanying drawings.

Figures 1A, 1B, 1C, 1D, 1E, 1F, 1G, 1H:
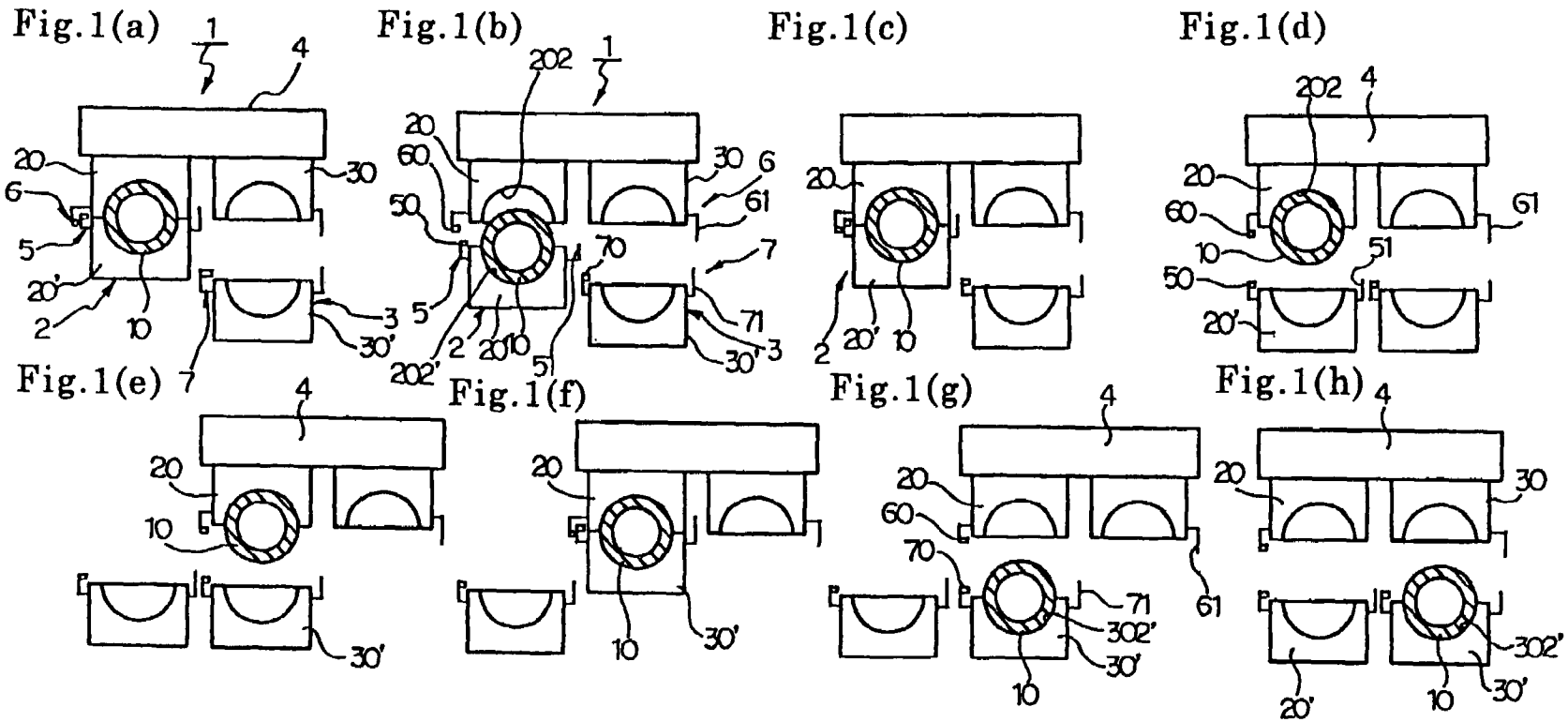
FIGS. 1(*a*) through 1(*h*) are plan views schematically illustrating the step of transferring a fiber molded article from a papermaking mold to a drying mold in an embodiment of the method for producing a fiber molded article according to the present invention.
Figures 2A, 2B, 2C, 2D:
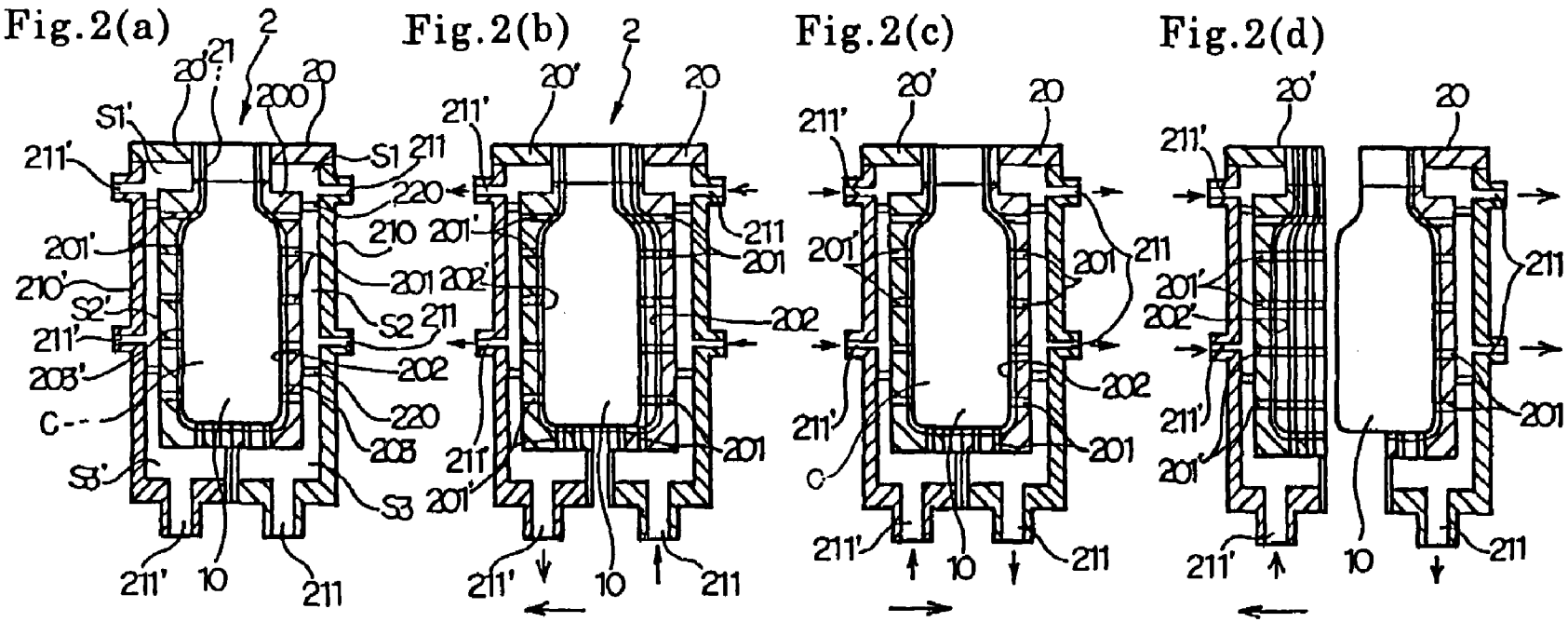
FIGS. 2(*a*) through 2(*d*) are partial cross-sections schematically illustrating the step of separating a molded article from the papermaking mold in the embodiment.
Figures 3A, 3B, 3C, 3D:
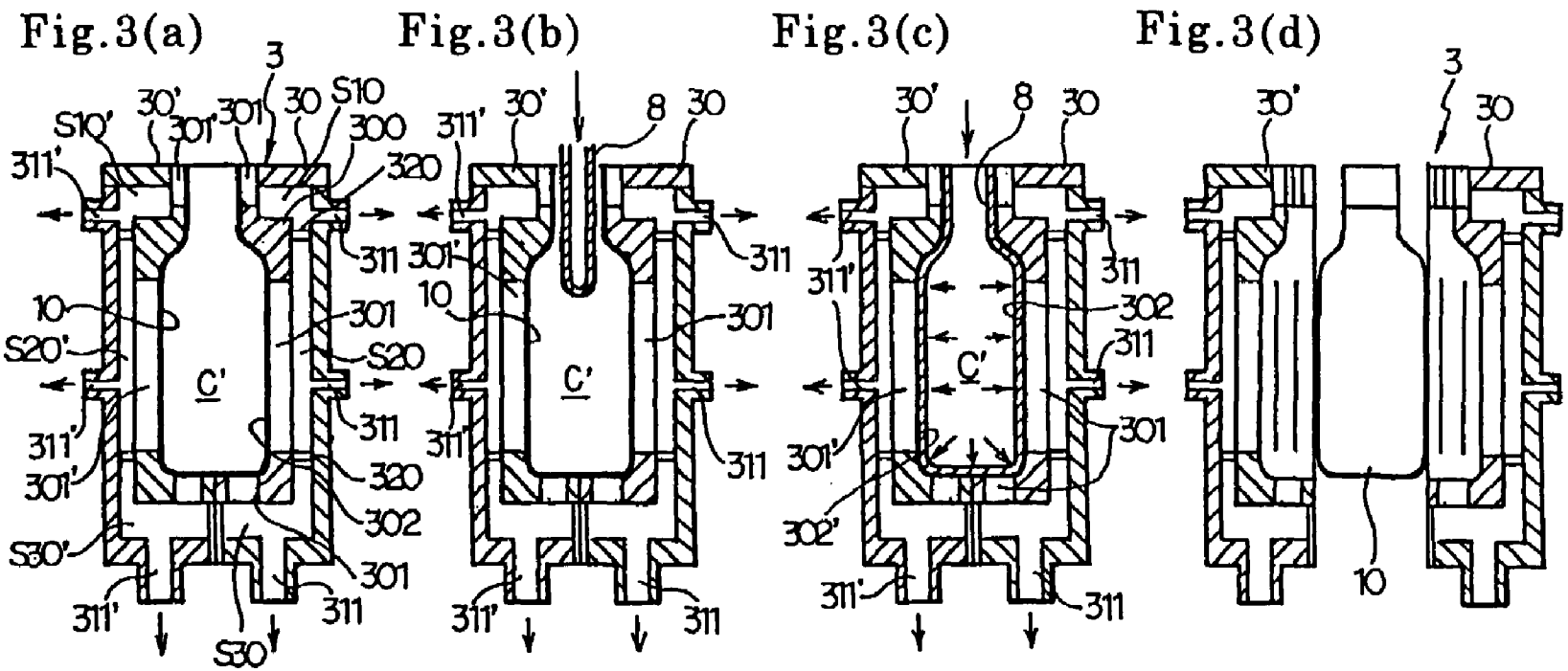
FIGS. 3(*a*) to 3(*d*) schematically illustrate the step of drying in the embodiment.

FIGS. 1 to 3 schematically illustrate the steps involved in the production of a fiber molded article by use of an embodiment of the apparatus according to the present invention. In the Figures, numeral 1 indicates an apparatus for producing a fiber molded article (hereinafter simply referred to as "the apparatus"), and numeral 10 indicates a fiber molded article.

As shown in FIG. 1, the apparatus 1 comprises a papermaking mold 2 composed of a pair of splits 20 and 20', a drying mold 3 composed of a pair of splits 30 and 30' which receives the fiber molded article 10 formed in the papermaking mold 2, a moving means (not shown) for moving the splits 20, 20', 30, and 30', a suction means (not shown) for attracting the fiber molded article 10 toward the inner surfaces of the papermaking mold and the drying mold, and a control means (not shown) for controlling the moving means and the suction means.

In the apparatus 1, the papermaking mold 2 and the drying mold 3 are adjacent to each other. The split 20 and the split 30 are fixed to a carriage 4 which is movable in the direction perpendicular to the opening and closure direction of the papermaking mold 2 and the drying mold 3. The split 20' and the split 30' are disposed to face the mating splits 20 and 30.

The moving means has a driving mechanism (not shown) for moving the carriage 4 and a mold clamping mechanism (not shown) for joining and clamping the splits 20 and 20' and the splits 30 and 30'. The mold clamping mechanism moves the splits in the direction perpendicular to the carriage 4 moving direction to open or close the papermaking mold 2 and the drying mold 3.

As shown in FIG. 2, the splits 20 and 20' constituting the papermaking mold 2 are joined to form a bottle-shaped cavity C.

The split 20 and the split 20' are symmetric and have the same configuration. Therefore, the splits will be described only with reference to the split 20.

The split 20 is composed of a main body 200 and a frame 210 surrounding the main body 200. There is a space between the main body 200 and the frame 210, which is divided into three chambers S1, S2, and S3 by partitions 220. The main body 200 has a large number of through-holes 201 interconnecting the space and the cavity C.

Flow channels 203 of prescribed width are engraved in a checkered pattern on the cavity-forming surface 202 of the split 20 to connect the through-holes 201.

The total open area ratio of the flow channels 203 to the total surface area of the cavity-forming surface 202 of the split 20 is preferably 10 to 85%, more preferably 40 to 80%, for stably performing the transfer of the molded article from the split of the papermaking mold 2 and the split of the drying mold 3.

A papermaking screen (not shown) having a prescribed opening size and a prescribed wire width is disposed on the cavity-forming surface 202 of the main body 200.

The frame 210 has flow passageways 211 which lead the chambers S1, S2, and S3 to the outside. Each flow passageway 211 is connected to a pipe line (not shown) leading to an evacuation source or a compressor. The cavity is evacuated by suction through the through-holes 201 and the flow passageways 211, and a pressurized fluid is fed into the cavity through the same route. Since such a single route serves for both evacuation by suction of the cavity and pressurized fluid feed into the cavity, the apparatus can be designed to have a reduced size.

The drying mold 3 has a heating means (not shown). It has the same configuration as the papermaking mold 2 except for having no papermaking screen.

As shown in FIG. 3, the splits 30 and 30' are joined to form the drying mold 3 having a bottle-shaped cavity C'.

The splits 30 and 30' have basically the same design except for being opposite so that only the split 30 will be described further.

The split 30 has a main body 300 and a frame 310 surrounding the main body 300. Partitions 320 are provided in the space between the main body 300 and the frame 310 to divide the space into three chambers S10, S20, and, S30.

The main body 300, which is conformed to the shapes of the neck, body and bottom of the molded article, has a large number of through-holes 301 connecting the space and the cavity C'.

The total open area ratio of the through-holes 301 on the cavity-forming surface (the ratio of the total open area to the total surface area of the cavity-forming surface) is preferably 0.5 to 20%, more preferably 0.8 to 10%, for stably transferring the molded article between the split of the papermaking mold 2 and the split of the drying mold 3.

The frame 310 has flow passageways 311 which lead the chambers S10, S20, and S30 to the outside. Each flow passageway 311 is connected to a pipe line (not shown) leading to an evacuation source or a compressor. The cavity is evacuated by suction through the through-holes 301 and the flow passageways 311, and a pressurized fluid is fed into the cavity through the same route. Since such a single route serves for both evacuation by suction of the cavity and pressurized fluid feed into the cavity, the apparatus can be designed to have a reduced size.

The control means has a sequence controller. The papermaking mold 2 is once opened while having the fiber molded article 10 attracted to the inner surface of the split 20' by suction, whereupon the fiber molded article 10 is separated from the inner surface of the split 20. The papermaking mold 2 is then closed, and the suction for attracting the fiber molded article 10 by the split 20' is stopped. The papermaking mold 2 is reopened while having the fiber molded article 10 attracted to the inner surface of the split 20 by suction. The split 20 is joined with the split 30', and the fiber molded article 10 is attracted onto the inner surface of the split 30' by suction. The split 30 is moved to face the split 30'. These operations (suction and movement) are carried out under control by the sequence controller.

As shown in FIG. 1(*b*), the apparatus 1 has sensing means 5 and 6 for monitoring the transfer of the fiber molded article 10 between the splits 20 and 20'.

The sensing means 5 comprises an optical sensor 50 having an emitter and a receptor and a reflector 51 which reflects the light from the emitter. The sensing means 5 detects whether there is any fiber molded article 10 in the split 20'. The optical sensor 50 and the reflector 51 are attached to the respective sides of the split 20' to face each other.

The sensing means 6 also comprises an optical sensor 60 and a reflector 61. The sensing means 6 detects whether there is any fiber molded article 10 in the split 20. The optical sensor 60 and the reflector 61 are attached to the outer side of the split 20 and the outer side of the split 30, respectively, so that they may face each other.

The apparatus 1 additionally has a sensing means 7 which, in cooperation with the sensing means 6, monitors the movement of the fiber molded article 10 between the split 20' and the split 30'.

The sensing means 7 comprises an optical sensor 70 and a reflector 71. The sensing means 7 detects whether there is any fiber molded article 10 in the split 30' and is attached to both sides of the split 30'.

In the apparatus 1, the control means is adapted to control the transfer means and the suction means in response to the detection output from these sensing means 5 to 7 as described infra.

A preferred embodiment of the method for producing a fiber molded article according to the present invention will be described based on the method of producing the fiber molded article 10 by using the apparatus 1 by referring to the drawings.

As shown in FIG. 2(*a*), the splits 20 and 20' are assembled to form the cavity C. A pulp slurry is injected under pressure into the cavity from the opening 21 at the top of the papermaking mold 2. The pulp slurry is injected by means of, for example, a pressure pump. The pulp slurry injection pressure is preferably 0.01 to 5 MPa, more preferably 0.01 to 3 MPa.

On injecting a predetermined amount of the pulp slurry into the cavity C, suction of the pulp slurry starts through the flow channels 203, the through-holes 201, and the flow passageways 211. The water content of the pulp slurry is thereby discharged out of the papermaking mold 2, while pulp fiber is deposited on the papermaking screen to build up a hollow bottle-shaped fiber molded article 10.

The pulp slurry is prepared by using pulp fiber generally employed in this type of pulp molded article fabrication. The pulp slurry is made solely of pulp fiber and water or may contain inorganic substances, such as talc and kaolinite, inorganic fibers, such as glass fiber and carbon fibers, particulate or fibrous thermoplastic resins, such as polyolefins, non-wood or plant fibers, and polysaccharides. The amount of the other components is preferably 1 to 70% by weight, more preferably 5 to 50% by weight, based on the total amount of the pulp fiber and these components.

After the fiber molded article 10 of prescribed thickness is formed, compressed air (heated air) is fed into the cavity C through the opening 21 while continuing the evacuation by suction of the cavity C through the flow channels 203 and 203', the through-holes 201 and 201', and the flow passageways 211 and 211'. The fiber molded article is thus dewatered to a prescribed water content. The pressure of the compressed air to be fed into the cavity C is preferably 0.01 to 5 MPa, more preferably 0.1 to 3 MPa.

The water content of the dewatered fiber molded article 10 is preferably 30 to 95%, more preferably 50 to 85%. The fiber molded article 10 with a water content less than 30% can fail to acquire sufficient surface properties during the drying step. If the water content exceeds 95%, the fiber molded article 10 needs a long time to dry in the drying step, which can result in reduced production efficiency or difficulty in transferring the fiber molded article 10 to the drying mold 3.

The soaking wet fiber molded article 10 is thus dewatered from the inside of the cavity C by feeding air into the cavity C while evacuating the cavity C by suction, the step of joining separately molded parts as required in conventional pulp molding techniques is unnecessary. Therefore, the resulting fiber molded article 10 has no joint seams. As a result, a finally obtained fiber molded article 10 has an enhanced strength and a good appearance.

After the fiber molded article 10 is dewatered to a prescribed water content, the compressed air feed into the cavity C through the opening 21 and the suction of the cavity C through the through-holes 201 and 201' and the flow passageways 211 and 211' are stopped.

The fiber molded article 10 formed in the papermaking mold 2 is then transferred to the drying mold 3 as described hereunder.

As shown in FIGS. 1(*b*) and 2(*b*), the cavity is evacuated by suction through the flow channels 203', the through-holes 201', and the flow passageways 211', whereby the fiber molded article 10 is attracted to the cavity-forming surface (inner surface) 202' of the split 20'. At the same time, compressed air is blown from the cavity-forming surface 202 of the split 20 to the fiber molded article 10 through the through-holes 201 and the flow passageway 211. In order to separate the fiber molded article 10 from the cavity-forming surface 202 of the split 20, the split 20' is moved to once open the papermaking mold 2. When the papermaking mold 2 is opened, compressed air blowing to the fiber molded article 10 is stopped. By releasing the intimate contact between the fiber molded article 10 and the papermaking screen on the inner side of the split 20 in this way, the fiber molded article 10 can be smoothly shifted from the split 20 to the split 30'.

For stable transfer of the fiber molded article 10, the suction force for attracting the fiber molded article to the cavity-forming surface 202' of the split 20' is preferably −20 to −95 kPa, more preferably −30 to −80 kPa. The pressure of compressed air blown from the split 20 to the fiber molded article 10 is preferably 0.1 to 0.6 MPa, more preferably 0.3 to 0.5 MPa, for assuring the stable transfer and for preventing damage to the fiber molded article 10 by compressed air.

As shown in FIGS. 1(*c*) and 2(*c*), the papermaking mold 2 is closed, and the suction for attracting the fiber molded article 10 is stopped. The cavity C is sucked through the through-holes 201 and the flow passageways 211 to attract the fiber molded article 10 to the cavity-forming surface 202 of the split 20. At the same time, compressed air is blown from the cavity-forming surface 202' of the split 20' to the fiber molded article 10 through the flow passageway 211' and the through-holes 201', and the papermaking mold 2 is again opened to separate the fiber molded article 10 from the split 20' as shown in FIGS. 1(*d*) and 2(*d*).

The suction force for attracting the fiber molded article 10 to the cavity-forming surface 202 of the split 20 is preferably −20 to −95 kPa, more preferably −30 to −80 kPa, for the same reasons as described supra. The pressure of the compressed air blown from the split 20' toward the fiber molded article 10 is preferably 0.1 to 0.6 MPa, more preferably 0.3 to 0.5 MPa, for the same reasons as described supra.

When the papermaking mold 2 is re-opened, the sensing means 5 and 6 detect whether the fiber molded article 10 has been properly transferred from the split 20' to the split 20. Where the light emitted from the emitter of the optical sensor 60 and reflected on the reflector 61 is no more detected by the receptor of the optical sensor 60, it is judged that the transfer has been done successfully. Where the light emitted from the emitter of the optical sensor 50 and reflected on the reflector 51 is not detected by the receptor of the optical sensor 50, it is judged that the transfer operation has failed. In this case, the papermaking mold 2 is again closed to repeat the transfer operation. If both the receptors of the optical sensors 50 and 60 detect light, it is judged that the fiber molded article 10 has fallen from the split 20 or 20'.

When the transfer has been done successfully, the carriage 4 moves the split 20 to a position where it faces the split 30' as shown in FIG. 1(*e*).

As shown in FIG. 1(*f*), the split 30' is brought closer to the split 20 and joined to the split 20. The fiber molded article 10 is then attracted to the cavity-forming surface 302' of the split 30' by suction through the through-holes 301' and the flow passageways 311'.

The suction force for attracting the fiber molded article 10 to the cavity-forming surface 302' of the split 30' is preferably −20 to −95 kPa, more preferably −30 to −80 kPa, for the same reasons as described supra. The pressure of the compressed air blown from the split 20 toward the fiber molded article 10 is preferably 0.1 to 0.6 MPa, more preferably 0.3 to 0.5 MPa, for the same reasons as described supra.

The split 30' is moved away from the split 20 thereby to release the fiber molded article 10 from the split 20 as illustrated in FIG. 1(*g*).

In this stage of moving the split 30', the sensing means 6 and 7 detect whether the fiber molded article 10 has been properly transferred from the split 20 to the split 30'. Where the light emitted from the emitter of the optical sensor 70 and reflected on the reflector 71 is no more detected by the receptor of the optical sensor 70, it is judged that the transfer has been done successfully. Where the light emitted from the emitter of the optical sensor 60 and reflected on the reflector 61 is not detected by the receptor of the optical sensor 60, it is judged that the transfer operation has failed. In this case, the transfer operation is repeated. If both the receptors of the optical sensors 60 and 70 detect light, it is judged that the fiber molded article 10 has fallen from the split 20 or 30'.

When the transfer has been done successfully, the carriage 4 moves to its original position to move the split 20 and the split 30 to positions where they face the mating split 20' and the mating split 30', respectively, as shown in FIG. 1(*h*).

The step of drying the undried fiber molded article by pressing will now be described with reference to the drawings.

The split 30' shown in FIG. 1(*h*) is brought closer to the split 30. As shown in FIG. 3(*a*), the two splits 30 and 30' are joined together to form the cavity C' in which the undried fiber molded article 10 is fitted. The drying mold 3 has previously been heated and maintained at a prescribed temperature.

As shown in FIG. 3(*b*), a hollow bag-like pressing member 8 is inserted into the inside of the fiber molded article 10 while the inside of the drying mold 3 is evacuated by suction through the through-holes 301 and 301' and the flow passageways 311 and 311'. As shown in FIG. 3(*c*), a pressurizing fluid is fed into the pressing member 8 to expand it. The expanded pressing member 8 presses the undried fiber molded article 10 toward the cavity-forming surfaces 302 and 302'. The pressing member 8 is preferably made of a film of a flexible material excellent in tensile strength, impact resilience, extensibility, and the like, such as fluororubber, silicone rubber or other elastomer.

The pressurizing fluid which can be used to expand the pressing member 8 includes gases and liquids, such as compressed air (heated air) and oil (heated oil). The pressure of the pressurizing fluid is preferably 0.01 to 5 MPa, particularly 0.1 to 3 MPa. Pressures lower than 0.01 MPa achieve reduced drying efficiency and can result in poor surface properties of the fiber molded article. Pressures exceeding 5 MPa necessitate scaling up the apparatus without offering further advantages in terms of drying efficiency or surface properties.

The expanded pressing member 8 presses the fiber molded article 10 toward the cavity-forming surfaces. As a result, the water of the fiber molded article 10 is removede from the through-holes 301 and 301', the flow passageways 311 and 311' as steam. Simultaneously with the progress of drying, the structure of the cavity-forming surfaces 302 and 302' is transferred onto the outer surface of the fiber molded article 10.

Since the fiber molded article 10 is pressed to the cavity-forming surfaces 302 and 302', it dries efficiently even if the cavity C' configuration may be complicated. Moreover, the structure of the cavity-forming surfaces 302 and 302' is transferred to the outer surface of the fiber molded article 10 with high precision.

On drying the fiber molded article 10 to a prescribed water content, the pressurizing fluid is withdrawn from the pressing member 8 to let the pressing member 8 shrink. The shrunken pressing member 8 is removed from the fiber molded article 10. The drying mold 3 is opened to take out the dried fiber molded article 10 from the drying mold as shown in FIG. 3(*d*).

As described above, in the method of producing a fiber molded article by use of the apparatus 1 according to this embodiment, the fiber molded article 10 is once released from the cavity-forming surface 202 of the split 20 before it is attracted to the split 20 by suction, and the fiber molded article 10 is then transferred from the split 20 to the split 30' of the drying mold 3. Therefore, the fiber molded article 10 formed in the papermaking mold 2 is transferred from the papermaking mold 2 to the drying mold 3 without fail.

The present invention is by no means limited to the above-described embodiment, and appropriate changes and modifications can be made therein without departing from the spirit and scope thereof.

While the present invention is preferably carried out by using sensing means equipped with an optical sensor and a reflector to monitor the transfer of a fiber molded article between the papermaking mold and the drying mold as in the embodiment, the sensor to be used is not particularly limited in type. For example, other types of sensors such as infrared sensors may be employed.

While the present invention is conveniently applied to the method in which a papermaking mold for forming a bottle-shaped fiber molded article is used, it is also applicable to the production of a fiber molded article by using a papermaking mold composed of a male and a female.

While the mold used in the embodiment for receiving a fiber molded article is a split constituting a drying mold, it may be replaced with an intermediate mold which mediates the transfer of a fiber molded article to a drying mold.

While, as in the embodiment, it is preferred to carry out both evacuation by suction and gas blowing for implementing transfer of a molded article between splits, gas blowing could be omitted if desired.

While, as in the embodiment, it is preferred that pressing of a fiber molded article by a pressing member is carried out only in the drying step, such pressing may be performed in the dewatering step.

While it is preferred that suction of the cavity and pressurizing fluid feed into the cavity be carried out through the same route as in the embodiment, these operations may be effected through separate routes.

INDUSTRIAL APPLICABILITY

The present invention provides a method and an apparatus for producing a fiber molded article in which a fiber molded article formed in a papermaking mold can securely be transferred to another mold.

The invention claimed is:

1. A method of producing a fiber molded article comprising the step of transferring the fiber molded article formed in a papermaking mold composed of a first split and a second split to a second mold composed of a third split and a fourth split, wherein the step of transferring is carried out by opening said papermaking mold while attracting the fiber molded article to an inner surface of said first split by suction to separate the fiber molded article from the second split, closing the papermaking mold, releasing the molded article from attraction to the inner surface of said first split, opening the papermaking mold again while attracting the fiber molded article to an inner surface of said second split by suction, joining said second split with said third split of said second mold, attracting the fiber molded article to an inner surface of said third split by suction, and separating the fiber molded article from said second split, wherein each of the first to fourth splits has flow passageways leading to an evacuation source or a compressor.

2. The method of producing a fiber molded article according to claim 1, wherein a gas is blown from the inner surface of said second split toward the fiber molded article.

3. The method of producing a fiber molded article according to claim 2, wherein said second mold includes a drying mold.

4. The method of producing a fiber molded article according to claim 1, wherein said second mold includes a drying mold.

5. The method for producing a fiber molded article according to claim 1, further comprising:

monitoring said transferring of said fiber molded article when said fiber molded article is received by said third split.

6. The method for producing a fiber molded article according to claim 5, wherein said monitoring includes monitoring said transferring of said fiber molded article with at least one optical sensor.

7. An apparatus for producing a fiber molded article comprising a papermaking mold composed of a first split and a second split, a second mold for receiving the molded article formed in the papermaking mold, said second mold composed of a third split and a fourth split, a moving means for moving the second and fourth splits, suction means for attracting the fiber molded article to an inner surface of each of the first, second, and third splits, and a control means for controlling the moving means and the suction means, wherein the control means controls the moving means and the suction means such that:

the papermaking mold is opened while attracting the fiber molded article to the inner surface of said first split of the papermaking mold by suction to separate the fiber molded article from the second split, the papermaking mold is closed, and the molded article is released from attraction to the inner surface of the first split, the papermaking mold is opened again while attracting the fiber molded article to the inner surface of said second split by suction to separate the fiber molded article from the inner surface of said first split, said second split is joined with said third split, and the fiber molded article is attracted to the inner surface of said third split, and the fiber molded article is separated from said second split, wherein each of the first to fourth splits has flow passageways leading to an evacuation source or a compressor.

8. The apparatus for producing a fiber molded article according to claim 7, which has a sensing means for monitoring the transfer of the fiber molded article when the fiber molded article is received by said second mold, and said control means controls said moving means and said suction means in response to an output from said sensing means.

9. An apparatus for producing a fiber molded article, the apparatus comprising:

a papermaking mold comprising a first split and a second split, said first split including a first suction element configured to attract and hold said molded article to an inner surface of said first split, said second split including a second suction element configured to attract and hold said molded article to an inner surface of said second split, and each of the first and second splits having flow passageways leading to an evacuation source or a compressor, each of said first split and said second splits including flow channels engraved on the inner surface thereof, a total open area ratio of the flow channels to a total surface area of the inner surface of each split is from 10% to 85%;

a second mold comprising a third split and a fourth split, said third split including a third suction element configured to attract and hold said molded article to an inner surface of said third split, and each of the third and fourth splits having flow passageways leading to an evacuation source or a compressor;

a moving element configured to move said second and fourth splits; and a controller configured to control said moving element and said first, second, and third suction elements.

10. The apparatus for producing a fiber molded article according to claim 9, further comprising:

a first optical sensor configured to detect said article in said first split.

11. The apparatus for producing a fiber molded article according to claim 10, further comprising:

a second optical sensor configured to detect said article in said second split.

12. The apparatus for producing a fiber molded article according to claim 11, further comprising:

a third optical sensor configured to detect said article in said third split.

13. The apparatus for producing a fiber molded article according to claim 9, further comprising:

a pressing member configured to be inserted in said article when said article is in said second mold, said member including a cavity configured to receive a pressurizing fluid to press said article against inner surfaces of said second mold.

14. The apparatus for producing a fiber molded article according to claim 13, wherein said pressurizing fluid is air.

15. The apparatus for producing a fiber molded article according to claim 13, wherein said pressurizing fluid is oil.

16. A method of producing a fiber molded article, the method comprising:

transferring a fiber molded article formed in a papermaking mold comprising a first split and a second split to a second mold comprising a third split and a fourth split, each of the first to fourth splits having flow passageways leading to an evacuation source or a compressor, wherein said transferring includes, opening said papermaking mold while attracting said fiber molded article to an inner surface of said first split by suction to separate said fiber molded article from said second split, closing said papermaking mold, releasing said molded article from attraction to said inner surface of said first split, opening said papermaking mold again while attracting said fiber molded article to an inner surface of said second split by suction, joining said second split with said third split of said second mold, attracting said fiber molded article to an inner surface of said third split by suction, and separating said fiber molded article from said second split.

17. The method of producing a fiber molded article according to claim 16, further comprising blowing a gas from said inner surface of said second split toward said fiber molded article when separating said fiber molded article from said second split.

18. The method of producing a fiber molded article according to claim 16, wherein said second mold includes a drying mold.

19. The method for producing a fiber molded article according to claim 16, further comprising:

monitoring said transferring of said fiber molded article when said fiber molded article is received by said third split.

20. The method for producing a fiber molded article according to claim 19, wherein said monitoring includes monitoring said transferring of said fiber molded article with at least one optical sensor.

* * * * *